United States Patent [19]

Petrovich

[11] 3,951,786

[45] Apr. 20, 1976

[54] OXIDIZING METHOD IN FROTH FLOTATION OF MINERALS

[76] Inventor: Vojislav Petrovich, 1925 W. Schiller St., Chicago, Ill. 60622

[22] Filed: Apr. 30, 1974

[21] Appl. No.: 465,408

[52] U.S. Cl. ..... 209/166

[51] Int. Cl.[2] ..... B03D 1/02

[58] Field of Search ..... 209/166, 167

[56] References Cited

UNITED STATES PATENTS

| | | | |
|---|---|---|---|
| 1,364,306 | 1/1921 | Perkins | 209/166 |
| 1,364,858 | 1/1921 | Perkins | 209/166 |
| 1,548,351 | 8/1925 | Clark | 209/166 |
| 1,852,109 | 4/1932 | Christmann | 209/166 |
| 2,410,377 | 10/1946 | Booth | 209/166 |
| 2,922,522 | 1/1960 | Fenske | 209/166 |
| 3,669,266 | 6/1972 | Sanders | 209/166 |

*Primary Examiner*—Robert Halper

[57] ABSTRACT

An improved method in concentration of oxide ores and minerals by froth flotation process which comprises subjecting a pulp of mineral slurry to the combined action of a organic nitrogen compound with one or more $NH_2$ group and hypochlorite in a slightly acid pulp of mineral slurry. The decomposition of the $NH_2$ group provokes a highly oxidizing state in the mineral slurry, a state which can change the valency state of any metal which can change the valency state from lower to higher of the metal at the mineral surface, thus rendering the mineral particle to be capable of activating the double carbon to carbon bonds of certain collectors possessing these bonds as are olefine alcohols or olefine glycols. The indicated compounds provide recovery of oxide minerals of iron, antimony, cerium, yttrium titanium and thorium, vanadium, niobium, tantalum, chromium, and wolfram.

1 Claim, No Drawings

OXIDIZING METHOD IN FROTH FLOTATION OF MINERALS

BRIEF SUMMARY OF THE INVENTION

This invention relates to an oxidation method in the mineral slurry which is based on an electron transfer reaction in connection with destruction of organic nitrogen compounds with $NH_2$ group or groups in the molecule when introduced in a slightly acidic pulp of the mineral slurry in the presence of hypochlorous acid or hypochlorite. Such a nitrogen compound decomposes gradually or instantly which depends from the chemical structure of organic nitrogen compound yielding and oxidizing state in the mineral slurry by liberating elemental nitrogen, rendering the metal at the mineral surface or a portion of the mineral surface to a higher oxidizing state. Elemental nitrogen is electron carrier and actively takes part in the electron transfer reaction, thus acting as an oxidizing agent rendering a higher metal valency state to the metal at the mineral surface, which is unstable and eager of bonding acting thus as an oxidizing agent from the mineral surface. The addition of a collector with double carbon to carbon bond, which has a disposable valency eager of bonding, forms an active state in the pulp of mineral slurry which forces a new state of things resulting in compounding the higher metal valency state of the metal at the mineral surface to the collector compound with frothing properties. The double carbon to carbon bond of the collector is lost, because the disposable $\pi$-bond binds directly to the metal, forming a kind of metal-organic compound. Thus, the higher oxidation state of the metal at the mineral surface acts as an oxidizing agent for the olefine alcohol used as collector, which stretches the disposable $\pi$-bond forming thus the metal-organic compound. The compound with double carbon to carbon bond in respective case olefine alcohol or olefine glycol having an oxidation-reduction potential of $\pm 0.52$ volt, is oxidized by the higher oxidation-reduction potential of the metal at the mineral surface which is in the range of peroxy acids and their salts, i.e., of $-1.0$ to $-2.0$ volt. The liberation of elemental nitrogen from organic $NH_2$ -nitrogen compounds is equivalent to liberation of elemental oxygen from inorganic peroxy compounds, which as electron carrier may oxidize to a higher oxidation state any metal with a variable valency being in ionic state or compounded in a mineral. Thus, any hypochlorite reacts with any hydrazine yielding an oxidizing state in the mineral slurry, which is equivalent in strength to the oxidizing strength provided by interaction of hypochlorite and hydrogen peroxide. The destruction of hydrazine liberates nitrogen; the destruction of hydrogen peroxide liberates oxygen; in both a nascent state is capable to oxidize any metal with a variable valency to a higher oxidizing state.

In respective case oxidation-reduction reaction in modern meaning has no more exclusive connection with augmenting or lowering of oxygen in oxidation-reduction reactions, for olefinic compounds as is in the respective case of this invention are electron acceptor, therefore acting as reducing agents, for, the liberated atomic nitrogen as well as the liberated atomic oxygen is electron carrier until they unite to nitrogen molecule (gas) or oxygen molecule (gas) respectively, which both in atomic and charged state are capable to oxidize any metal with variable valency to a higher oxidizing state.

The minerals and ores of which the metal value are to be floated out when pretreated in the aforesaid manner, presumably change the valency state at the mineral surface of respective metal. Thus, the involved higher oxidizing state of the respective metal at the mineral surface presumably activates the double bond of a given collector-frother, effecting in this way a succesful flotation of the desired metal values from the mineral slurry. Among such ores and minerals, to the beneficiation of which this invention is particularly adapted are the oxide ores of iron, antimony, titanium, thorium, vanadium, niobium, tantalum, chromium, wolfram, as well as the phosphates of uranium, cerium and yttrium, i.e., oxide ores of iron as are hematite magnetite, ferrite of chromium as is chromite, oxide ores of antimony as are servantite and senarmontite, dioxides of titanium as are rutile, brookite, and anatase, dioxides of thorium as are thorite, uranothorite, thoriyanite, titanate as is ilmenite, vanadates of lead, copper, and zinc, niobate and tantalate as are mossite, tantalite and pyrochlore, wolframate, as are wolframite and scheelite, as well as various uranium minerals.

Stated more particularly I have discovered that nitrogen compounds with $NH_2$ group in the molecule such as:

| | |
|---|---|
| Hydrazine | $H_2N - NH_2$ |
| Methylhydrazine | $CH_3.NH.NH_2$ |
| Hydroxylamine | $HO.NH_2$ |
| Methylhydroxylamine | $CH_3O.NH_2$ |
| Carbohydrazide | $NH_2.NH.CO.NH.NH_2$ |
| Semicarbazide | $NH_2.NH.CO.NH_2$ |
| Methylsemicarbazide | $NH_2.N(CH_3).CO.NH_2$ |
| Thiosemicarbazide | $NH_2.NH.CS.NH_2$ |
| Thiocarbamide | $NH_2.CS.NH_2$ |
| Carbamide | $NH_2.CO.NH_2$ |
| Acetamide | $CH_3.CO.NH_2$ |
| Maloneamide | $CH_2(CO.NH_2)_2$ |
| Succineamide | $(CH_2CO.NH_2)_2$ |
| Oxamide | $NH_2.CO.CO.NH_2$ |
| Guanidine | $HN{=}C(NH_2)_2$ |
| Ethylene diamine | $NH_2.CH_2.CH_2.NH_2$ |
| Propylene diamine | $NH_2.CH_2.CH_2.CH_2.NH_2$ |

decompose in presence of hypochlorite in a slightly acid pulp of mineral slurry, liberating elemental nitrogen.

Thus, the object of this invention is to provide an improved process of beneficiating or concentrating oxide ores and minerals.

Another object of the present invention is a beneficiation process effective economically to recover the heretofore said metallic values primarily from silica and silicate gangue minerals.

A still further object of this invention is to subject oxide ores to froth flotation thus collecting a concentrate having improved sales appeal both as to grade and purity.

Still further objects of this invention will be apparent upon a complete understanding of the invention as hereinafter more fully described.

The collectors useful and used in recovering of minerals of this invention are olefine alcohols or olefine glycols said olefine alcohols or glycols having 5 to 15 carbon atoms. Being alcohols these collectors have pronounced frothing properties.

The collectors used in this invention presumably function by the chemical reaction based on the activation of the double carbon to carbon bond, by the action of the higher valency state of the metal at the mineral surface, or portion of the mineral surface, which is provoked by the action of the powerful oxidizing state arisen from combined action-decomposition of $NH_2$-nitrogen compounds and hypochlorite, thus forming addition compounds of metal-hydrocarbon-air complexes. It is obvious that the hydrocarbon part of the compound is oriented outward from the said mineral particle. Thus the attachment of the collector to the particle forms a water repellent surface or barrier around at least a part of the surface of the ore particle and thereby facilitates the formation of froth when the ore slurry is agitated in the presence of air.

It is preferable to operate the flotation with fresh water after conditioning in a oxidizing media, thus cycloning the oxidized mineral slurry followed by addition of fresh water is preferable. After oxidizing of the mineral surface is accomplished the collector and auxiliary agents, if any are to be used, are added for further treatment in the flotation equipment. In the flotation cell the ore pulp is contacted with air by agitation to form a froth to achieve the desired separation of the metal values form the gangue. In most cases it is advantageous to use a multiple stage flotation process to treat the underflow or partially metal value barren pulp to increase the degree of separation or to enhance the grade of recovery. Also, the use of varying amounts of emulsifiers, dispersants, and depressants etc. in different stages may be used to advantage to obtain the highest yield and best separation.

The flotation plant practice applying the inventor's method by serving the oxidizing principle in recovering of metal values, i.e., oxidizing the metal at the mineral surface to a higher valency state by the action of destroying the $NH_2$ group in respective nitrogen compounds with hypochlorite, and floating the mineral value with olefine alcohol, or olefine glycol; the ore is crushed, milled and sized to at least about 80 to 120 mesh standard sieve, which depends on the particular ore treated. Milling to finer sizes is preferable. The crushed and sized ore is pulped and as a mineral slurry is ready for treatment in the flotation equipment, i.e., by passing through the conditioner for the treatment with oxidizing agents such as the combined action of organic compounds with $NH_2$ group or groups and hypochlorite. From the conditioner the pulp of mineral slurry is pumped to thickener for accomplishing the oxidation. From the thickener the mineral slurry is pumped through a cyclone bank for eliminating the most part of the processed water. The overflow of the thickener, i.e., the processed or reagentized water is sent to milling and conditioner sections. The cyclone underflow is pulped with fresh water and pumped to the receiving box of the first stage flotation bank, where collector as is olefine alcohol or olefine glycols is added. In the main flotation bank, i.e., the first stage flotation bank, the froth produced by agitation and aeration is skimmed or is overflowing in the usual manner. The flotation underflow liquor, the filtrating liquor may be reused in the flotation circuit.

Having disclosed the novel combination of oxidizing agents of this invention as well as the handling of the mineral slurry, I have to say the final object of this invention is to provide a method for the recovery of minerals containing oxides of iron, antimony, cerium, yttrium, thorium, titanium, vanadium, niobium, tantalum, chromium, and wolfram and uranium.

The above discussion illustrates my invention in a general way, but for a detailed illustration thereof the examples of flotation procedure are set forth below.

The procedure in performing the laboratory examples for iron, antimony, titanium, chromium, wolfram ores was of the same manipulation as follows:

500 grams of ore was ground wet at 67 percent solids by weight in a laboratory ball mill to pass 100 mesh sieve for iron -hematite- feed; 80 mesh sieve for antimony oxide feed; 100 mesh sieve for rutile feed; 120 mesh sieve for chromite feed; 120 mesh sieve for scheelite. Each sample is reagentized with oxidizing agents in a laboratory conditioner for 5 minutes, then the liquor of the processed sample was decanted. Transfering the reagentized feed in the flotation machine, the froth flotation of the desired metal value is accomplished with fresh water and the addition of olefine alcohol or olefine glycol as collector. The amount of oxidant of organic nitrogen-$NH_2$ compound and hypochlorite, as well as collector, olefine alcohol or olefine glycol, as well as the grade and the recovery, are indicated in the accompaning table. Before skimming of the rougher concentrate, the pulp of mineral slurry was conditioned and aerated for 3 to 5 minutes. The rougher concentrates were skimmed from about 5 to 10 minutes, and afterwards cleaned with processed water.

The procedure for performing the beneficiation test for monazite, carnotite, fergusonite, and thorite was as follows:

The flotation test of sized sample was accomplished in a 50 grams flotation cell with 5 grams of monazite, carnotite, fergusonite, thorite respectively, and 45 grams of crystalline material containing feldspar, mica-micaschist, sandstone and the like material. The addition or reagents was done dropwise. The recovery of monazite, carnotite, fergusonite, and thorite was obtained by microscopic count.

| Ore treated | Activator pound per ton | Collector pound per ton | Assay of products | | |
|---|---|---|---|---|---|
| | | | Feed | Conc. | Recovery |
| Example 1 | Carbamide 0.2 NaClO | Dodecenol glycol | Fe % | Fe % | Fe % |
| Hematite | 0.2 | 0.4 | 28.2 | 66.2 | 91.0 |
| Example 2 | Oxamide 0.3 NaClO | Octenol | Sb % | Sb % | Sb % |
| Antimony oxide | 0.3 | 0.3 | 12.3 | 73.7 | 94.2 |
| Example 3 | Carbohydrazide 0.3 NaClO | Dodecenol glycol | $TiO_2$% | $TiO_2$% | $TiO_2$% |
| Rutile | 0.2 | 0.3 | 12.2 | 95.0 | 96.1 |
| Example 4 | Ethylene diamine 0.2 | Dodecenol glycol | Ti % | Ti % | Ti % |

-continued

| Ore treated | Activator pound per ton | Collector pound per ton | Assay of products Feed | Conc. | Recovery |
|---|---|---|---|---|---|
| Ilmenite | NaClO 0.2 | 0.3 | 8.0 | 29.7 | 95.2 |
| Example 5 | Hydrazine 0.2 | Dodecenol glycol | $Cr_2O_3$ | $Cr_2O_3$ | $Cr_2O_3$% |
| Chromite | NaClO 0.2 | 0.4 | 24.2 | 47.1 | 93.0 |
| Example 6 | Hydroxylamine 0.2 | Octenol | $WO_3$% | $WO_3$% | $WO_3$% |
| Sheelite | NaClO 0.2 | 0.1 | 2.8 | 58.8 | 91.4 |
| Example 7 Monazite | Guanidine NaClO | Pentenol Octenol | — by microscopic count | — | 90.0 |
| Example 8 Carnotite | Acetamide NaClO | Pentenol Octenol | — by microscopic count | — | 88.0 |
| Example 9 Fergusonite | Carbamide NaClO | Pentenol Octenol | — by microscopic count | — | 85.0 |
| Example 10 Thorite | Semicarbazide NaClO | Pentenol Octenol | — by microscopic count | — | 83.0 |

It is to be understood that the heretofore detailed discussion is for the purpose of illustration only, and is not intended as being limiting to the spirit of the invention or scope of the appended claims.

I claim:

1. An improved method of beneficiating ores and minerals selected from the group of oxide ores and minerals of iron, antimony, cerium, yttrium, thorium, titanium, vanadium, niobium, tantalum, chromium, wolfram, and uranium by a froth flotation process to produce a froth concentrate of desired metal values, which improvement comprises effecting froth flotation of the ore by treating the comminuted ore of the mineral slurry with organic nitrogen compounds selected from the group consisting of hydrazine, hydroxylamine, carbamide, acetamide, oxamide, guanidine, semicarbazide, carbohydrazide, ethylene diamine decomposing said compounds in the presence of hypochlorous acid or a hypochlorite in a slightly acid pulp of mineral slurry (which compounds act as oxidizing agent-vehicle by self destruction) to liberate elemental nitrogen which takes part in an electron transfer reaction of oxidizing the metal at the mineral surface of the mineral particles to be floated adding an effective amount of an olefine alcohol or olefine glycol collector, said alcohols or glycols having from 5–15 carbon atoms, said oxidized metal reacting with the collector at its double bond; and recovering a froth concentrate relatively rich in the desired metal value to leave the tailings relatively poor in the desired metal values.

* * * * *